US006347728B1

(12) United States Patent
Apolloni et al.

(10) Patent No.: US 6,347,728 B1
(45) Date of Patent: Feb. 19, 2002

(54) DISPENSER WITH RECIPROCATING ACTION

(75) Inventors: Giambattista Apolloni, Cogollo del Cengio; Giancarlo Brun, Thiene, both of (IT)

(73) Assignee: Tecnologia S.A.S. Di Valentino Brazzale & C., Cogollo del Cengio (IT)

( * ) Notice: Subject to any disclaimer, the term of this patent is extended or adjusted under 35 U.S.C. 154(b) by 0 days.

(21) Appl. No.: 09/600,608

(22) PCT Filed: Jan. 20, 1999

(86) PCT No.: PCT/IT99/00010

§ 371 Date: Sep. 5, 2000

§ 102(e) Date: Sep. 5, 2000

(87) PCT Pub. No.: WO99/36333

PCT Pub. Date: Jul. 22, 1999

(30) Foreign Application Priority Data

Jan. 20, 1998 (IT) ..... B098A0013

(51) Int. Cl.[7] ..... B67D 5/42
(52) U.S. Cl. ..... 222/320; 222/390
(58) Field of Search ..... 222/390, 391, 222/321.1, 321.6, 326, 320

(56) References Cited

U.S. PATENT DOCUMENTS

| | | | | | |
|---|---|---|---|---|---|
| 1,659,912 | A | * | 2/1928 | Geake | 222/390 |
| 2,732,101 | A | * | 1/1956 | Sohn | 222/320 |
| 3,420,417 | A | * | 1/1969 | Kardel | 222/390 |
| 4,506,810 | A | * | 3/1985 | Goncalves | 222/391 |
| 4,803,810 | A | | 2/1989 | Czetwertynski | 222/319 |

FOREIGN PATENT DOCUMENTS

| | | |
|---|---|---|
| DE | 8006108 | 12/1981 |
| DE | 8135544 | 7/1983 |
| DE | 8307899 | 7/1984 |

* cited by examiner

*Primary Examiner*—Kenneth Bomberg
(74) *Attorney, Agent, or Firm*—Hedman & Costigan, P.C.

(57) ABSTRACT

A manual, electric, air-operated, or oil operated dispenser with reciprocating action comprises a reservoir with a mouth in which tubular body is fitted. An internal duct formed in the tubular body opens outside a covering element disposed adjacent the mouth of the reservoir. A piston mounted for sliding in a leaktight manner inside the reservoir is advanced for forward travel of a predetermined maximum extent so that the product contained in the reservoir is dispensed to the exterior through the duct formed in the tubular body. During the return travel of the actuator means towards the starting position, the piston remains stationary in the position reached at the end of the forward travel.

4 Claims, 5 Drawing Sheets

DISPENSER WITH RECIPROCATING ACTION

BACKGROUND OF THE INVENTION

The present invention relates to a manual, electric, air-operated or oil-operated dispenser with reciprocating action for dispensing predetermined quantities of fluid or paste-like products such as food products, toothpaste, lubricating oils, soaps and the like. Devices for dispensing predetermined quantity of paste-like product are known, for example, from U.S. Pat. No. 4,805,810, which discloses a dispensing device comprising a reservoir, and a sliding mounted plunger shaft, with a piston member connected thereof. The extent of the travel of the piston member, and therefore the volume of the product dispensed, is determined by how deep the plunger shaft penetrates into the container. Said depth of penetration is determined by the distance that an actuator means may be moved downwardly before it encounters an adjustable abutment shoulder.

The object of the invention is to provide a device of the type indicated above which is easy and inexpensive to manufacture and which can be used quickly and easily. A further object of the invention is to provide a low-cost device which can be refilled easily even by unskilled personnel, preferably by means of "disposable" refill reservoirs of containers.

A further object of the invention is to provide a device which is available for use immediately without the need for complex operations to decant fluid or paste form one container to another.

SUMMARY OF THE INVENTION

The subject of the invention is a device which is a manual, electric, air-operated or oil-operated dispenser with reciprocating action for dispensing fluid or paste products. The dispenser comprises a reservoir body (11, 20, 36) which communicates with a duct (24,43) having an opening outside of the reservoir body, a piston member (18,31, 41) which is mounted for sliding in a leakproof manner outside of the reservoir body, having actuator means which can travel from a starting position and cause the piston member to advance for a predetermined length, the position of the piston member remaining fixed during the return travel of the actuator means to the starting position.

Further characteristics and advantages will become clear from the following detailed description of some embodiments of the invention, given with reference to the appended drawings, provided purely by way of non-limiting example, in which:

DETAILED DESCRIPTION OF THE INVENTION

Figure 1:
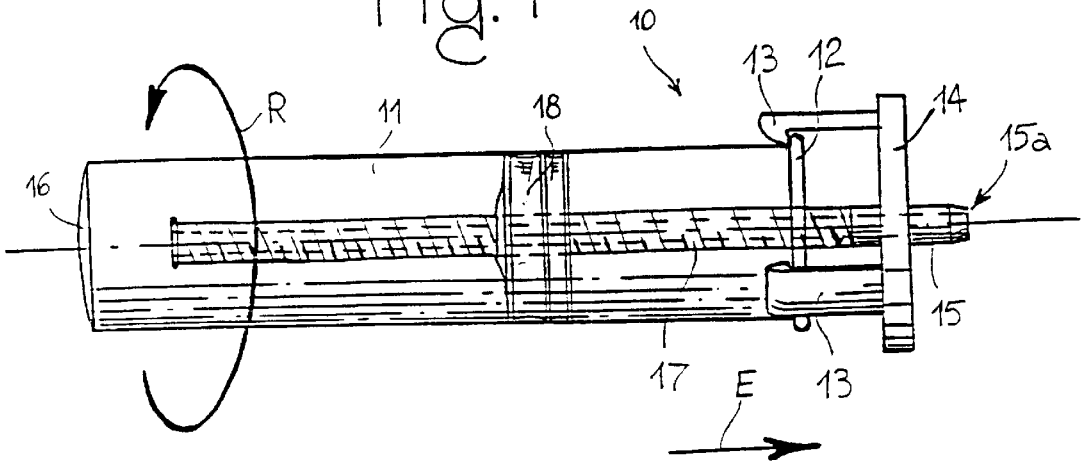
FIG. 1 is a side view of a first embodiment of the invention.

With reference now to FIG. 1, a first embodiment of a dispenser 10 comprises an elongate, cylindrical, cup-like body 11 with an annular projection 12 disposed at its mouth. The projection 12 is engaged by flexible teeth 13 projecting from a disk-shaped structure 14 through which a tubular dispensing duct 15 extends. The dispensing end 15*a* of the duct 15 projects from the disk 14 on the opposite side to the flexible teeth 13. At the opposite end to the dispensing end 15*a*, the duct 15 extends into the cup-like body 11 but without touching the end 16 thereof. The distance between the end of the duct 15 and the end 16 of the cup-like body is substantially equal to the distance between the mouth of the cup 11 and the disc 14 in the farthest-apart position shown in FIG. 1.

A thread 17 is formed on the outer surface of the duct 15, at the opposite end to the dispensing end 15*a*, and a cylindrical piston 18, preferably made of resilient material and mounted for sliding in a leak-tight manner inside the cup-like body 11, is screwed onto the thread.

When the dispensing device 10 shown in FIG. 1 is in use, a cup-like body 11 containing the fluid or the paste to be dispensed is engaged on the flexible teeth 13 of the disk 14 so that the piston 18, which has previously been screwed to a position close to the disc 14, closes the mouth of the cup-like body 11. In order to dispense a predetermined quantity of fluid or paste, it suffices to press the bottom 16 of the cup- like body 11, moving the mouth thereof towards the disc 14. The piston 18 thus moves partially into the cup-like body 11 from which a quantity of fluid or paste corresponding substantially to a cylindrical volume having a base equal to the inside diameter of the cup-like body 11 and a height equal to the length of the flexible teeth 13 emerges through the axial hole in the duct 15. Naturally, the manual dispensing operation may be interrupted before the mouth of the cup-like body 11 meets the disk 14 during its movement in the direction of the arrow E of FIG. 1.

In order to return the dispenser 10 to the initial position ready for the next dispensing operation, it suffices to rotate the cup-like body 11 in the direction of the arrow R of FIG. 1. Owing to the friction between the internal walls of the cup-like body 11 and the piston 18, the piston is thus rotated by the cup-like body 11 and acts on the thread 17 of the duct 15 so as to move the duct away from the end 16 of the cup-like body and consequently to move the disk 14 away from the mouth of the cup-like body 11.

Another method may also be used to operate the dispensing device 10 in order to dispense a quantity of fluid or paste other than the predetermined quantity. In fact, it suffices to rotate the cup-like body 11 directly in the direction of the arrow R of FIG. 1; owing to the friction between the internal walls of the cup-like body 11 and the piston 18, the piston is thus rotated by the cup-like body 11 and simultaneously gradually moves into the cup-like body, being translated relative thereto by virtue of the thread 17. A quantity of fluid or paste proportional to the angle of the rotation imparted to the cup-like body 11 thus emerges from the axial hole in the duct 15; a graduated scale on which the translational displacement of the piston 18 can be read may be applied to the cup-like body, in order to measure this quantity. With this method, the dispenser 10 always remains in the initial position and is thus ready for a subsequent dispensing operation by one or other of the two above-mentioned methods.

When, as a result of successive and repeated dispensing operations, the piston 18 has reached the end of the duct 15, the cup-like body 11 can be released, the piston 18 can be screwed back to a position close to the disk 14, and the teeth 13 can be engaged on the rim 12 of the container 11 which is once more filled with the product to be dispensed. Preferably, a plurality of "disposable" cup-like bodies 11, for example, provided with tear-off closure film or the like on their mouths, may be provided.

Figure 2:
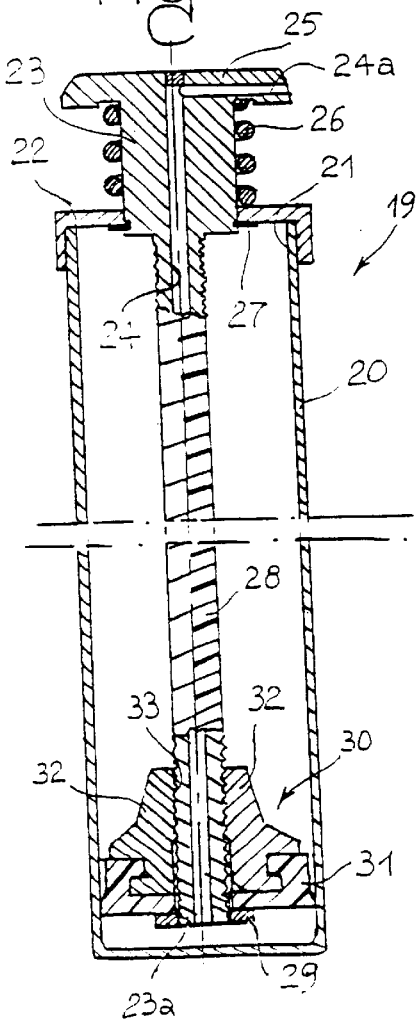
FIG. 2 is a longitudinal section of a second embodiment of the invention.

FIG. 2 shows another embodiment of a manual dispenser, generally indicated 19. In this embodiment, a substantially cylindrical container 20 has a mouth 21 covered by a cap 22 through which a dispensing rod 23 is mounted for sliding axially, the rod 23 having an axial through duct 24 opening in the container 20 at one end and communicating, at the other end, with a transverse dispensing duct 24a formed in the body of a push-button 25 integral with the rod 23.

A resilient element, for example, a helical spring 26, is interposed between the push-button 25 and the cap 22. A stop device 27, for example, a ring fitted in the rod 23, defines a travel limit for the movement of the rod 23, which is subject to the action of the spring 26. Inside the container 20, the rod 23 has an elongate portion of smaller diameter, the outer surface of which has a thread 28 as far as the end portion 23*a* of the rod 23 to which a travel-limit abutment 29 is fixed.

A piston body, generally indicated 30, mounted on the thread 28 of the rod 23, comprises a disk 31 of resilient material preferably rubber, movable axially in the container 20 by sliding in a leaktight manner against the internal walls thereof. The rubber disk 31 has an axial hole through which the rod 23 can extend and holds a plurality of jaws 32 resiliently in contact with the thread 28, the inner faces of the jaws 32 having a thread 33 which mates with the thread 28 of the rod 23.

When the dispenser 19 is in use, the piston unit 30 is first of all arranged in a position close to the cap 22. The threaded portion of the rod 23 and at least the rubber portion 31 of the piston body 30 are introduced into a pre-arranged container 20 containing the product to the dispensed, so that the cap 22 is closed onto the mouth of the container 20. The cap 22 may be fixed to the container 20 by various methods, for example, by pressure, by a screw-thread, by snap-engagement, etc. If the push-button 25 is pressed, a predetermined quantity of product is dispensed since the piston unit 30 is pushed into the container 20, compressing the product contained therein and forcing it through the duct 24 to the dispensing duct 24a. If the push-button 25 is released, the spring 26 causes the rod 23 to return, tending to retract the piston unit 30. However, the friction exerted by the resilient body 31 on the internal walls of the container 20 causes the jaws 32 to open out and the thread 33 consequently to be released from the rod 23. Whilst the rod 23 returns to a starting position ready for a new dispensing operation, the piston unit 30 thus remains stationary relative to the container 20. Repeated operations of the push-button 25 cause the piston unit 30 to advance progressively into the cylindrical body 20 and predetermined quantities of fluid product subsequently to be dispensed until the resilient body 31 reaches the end abutment 29 disposed at the end 23*a* of the rod 23.

Naturally, many variations may be applied to the dispensing device 19 illustrated in FIG. 2. For example, the thread 28 on the body of the rod 23 and the corresponding thread 33 on the jaws 32 may be replaced by a simple series of teeth or grooves or the like formed on the rod 23 and correspondingly on the internal portion of the jaws or clamps 32. In order to return the piston unit 30 to a position close the cap 22, it is thus necessary to move the jaws 32 away from the rod 23 by acting on the resilient body 31, once the rod 23 has been removed from the empty product container 20.

Figure 3:
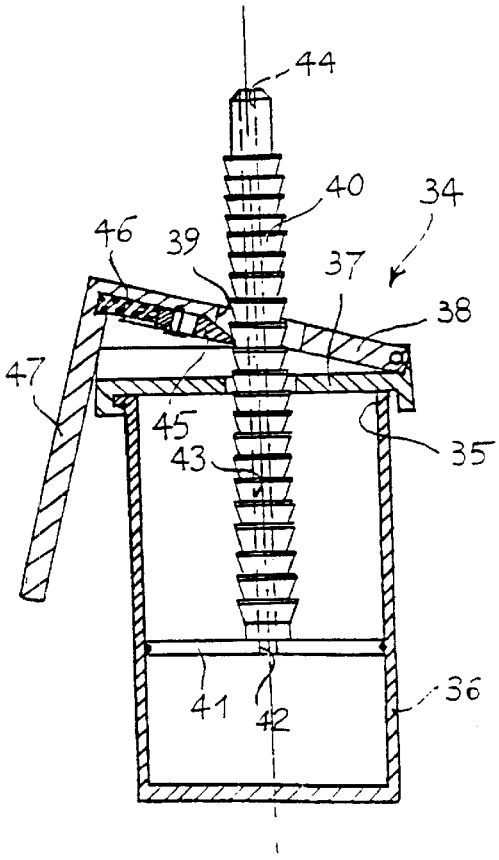
FIG. 3 is a longitudinal section of a third embodiment of the invention.

FIG. 3 shows another embodiment of a dispenser 34 in which a dispenser unit comprising a cap 37 is mounted on the mouth 35 of a substantially cylindrical container 36. In the embodiment shown in FIG. 3, the cap 37 is mounted on the container 36 by means of a bayonet system but, naturally, an expert in the art will be able to identify wholly equivalent, preferably quick-fit, closure systems. An upper portion of the cap 37 is formed as a lever 38 articulated to one end of the cap 37. The lever 38 has a slot 39 and a toothed rod 40, which extends through the slot 39 and through the cap 37 into the container 36, is fixed to a piston 41 which can slide in a leaktight manner inside the container 36. An opening 42 formed in the lower face of the piston 41 communicates with an axial duct 43 formed inside the rod 40 and opening outside the cap 37 at a dispensing end 44.

A drive tooth 45 mounted for sliding on the lever 38 is kept in contact with the rod 40 by a resilient element 46, for example, a helical spring. An operating handle 47 is fixed to the lever 38 and a resilient member (not shown in FIG. 3) keeps the lever 38 raised from the cap 37, and hence keeps the handle 47 spaced from the surface of the container 36, in normal conditions.

When the dispenser 34 is in operation, a movement of the handle 47 towards the body of the container 36 causes the rod 40 to be moved by the tooth 45 and the piston 41 consequently to move towards the bottom of the container 36. The axial movement of the piston 41 causes the product to emerge from the dispensing end 44 through the opening 42 and the duct 43. When the handle 47 and the lever 38 have reached the end of their travel, the resilient return element (not shown) moves the lever 38 away from the cap 37 and causes the drive tooth 45 to slide on the sloping surfaces of the teeth of the rod 40, which remains in the position reached. When the piston 41 has reached the bottom of the container 36 the container can be released from the cap 37 which, together with the rod 40 and the piston 41, can be re-used with a new refill of product.

Figure 4:
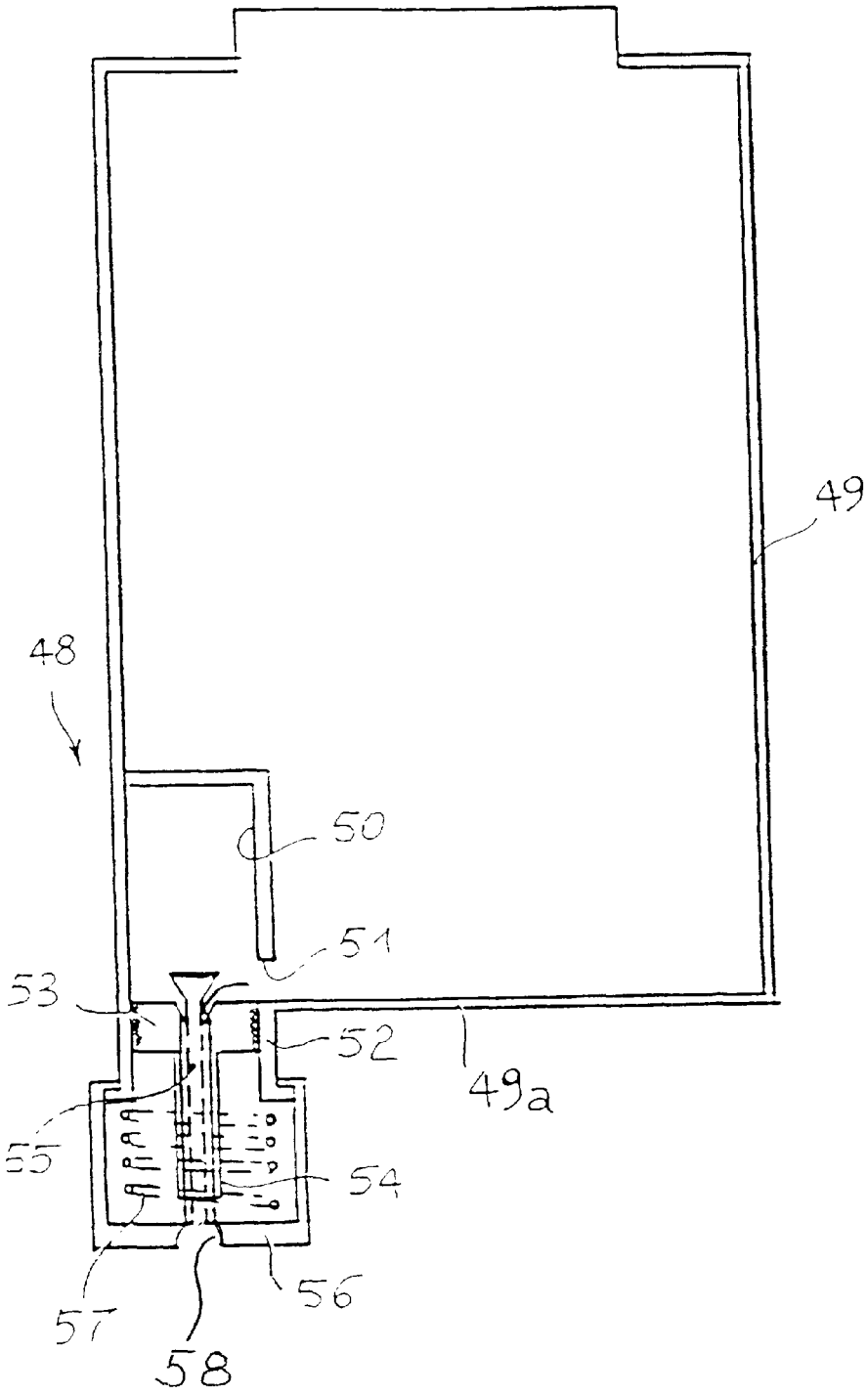
FIG. 4 is a longitudinal section of a further embodiment of the invention.

Finally, FIG. 4 shows a dispenser 48 which can be used, for example, for dispensing products, for example, soaps, detergents, and the like, from a large-capacity container 49, preferably fixed in a predetermined position, for example, on a wall. Inside the container 49, in the vicinity of its base 49*a*, there is an internal, preferably cylindrical chamber 50 communicating with the interior of the container 49 through an opening 51. Beneath the chamber 50, the base 49*a* opens into a cylindrical duct 52 in which a piston 53 with a bore slides, the piston comprising a lower rod 54, also with an axial hole. A pin 55 movable axially inside the hole in the piston 53 and in the rod 54 has its lower end fixed to a push cap 56 which is normally kept in the position indicated in FIG. 4 by the force of a spring 57, and in the base of which a dispensing nozzle 58 is formed.

When the dispenser 48 is in operation, a pressure inserted upwards on the push cap 56 from below causes the piston 53 to be raised and to close the opening 51, whilst the fluid or paste-like product is dispensed through the nozzle 58. When the push cap 56 is released, the spring 57 returns the dispenser 48 to the position shown in FIG. 4, ready for a new dispensing operation.

Figure 5:
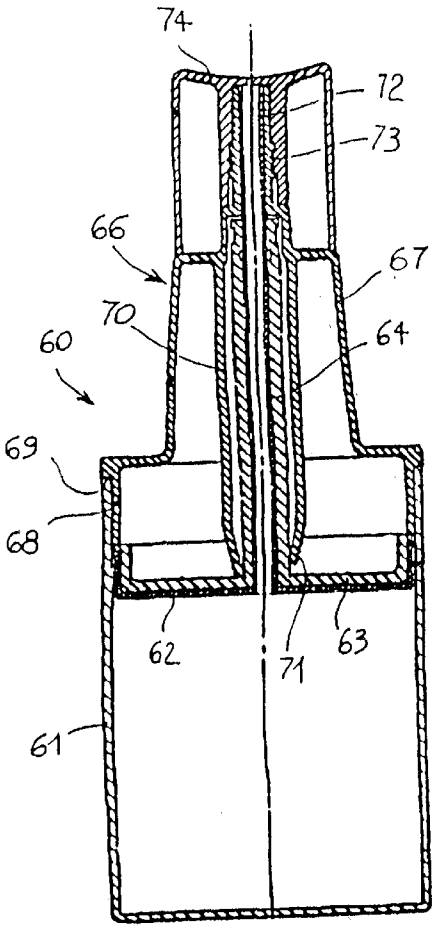
FIG. 5 is a longitudinal section of another embodiment of the invention.
Figure 8:
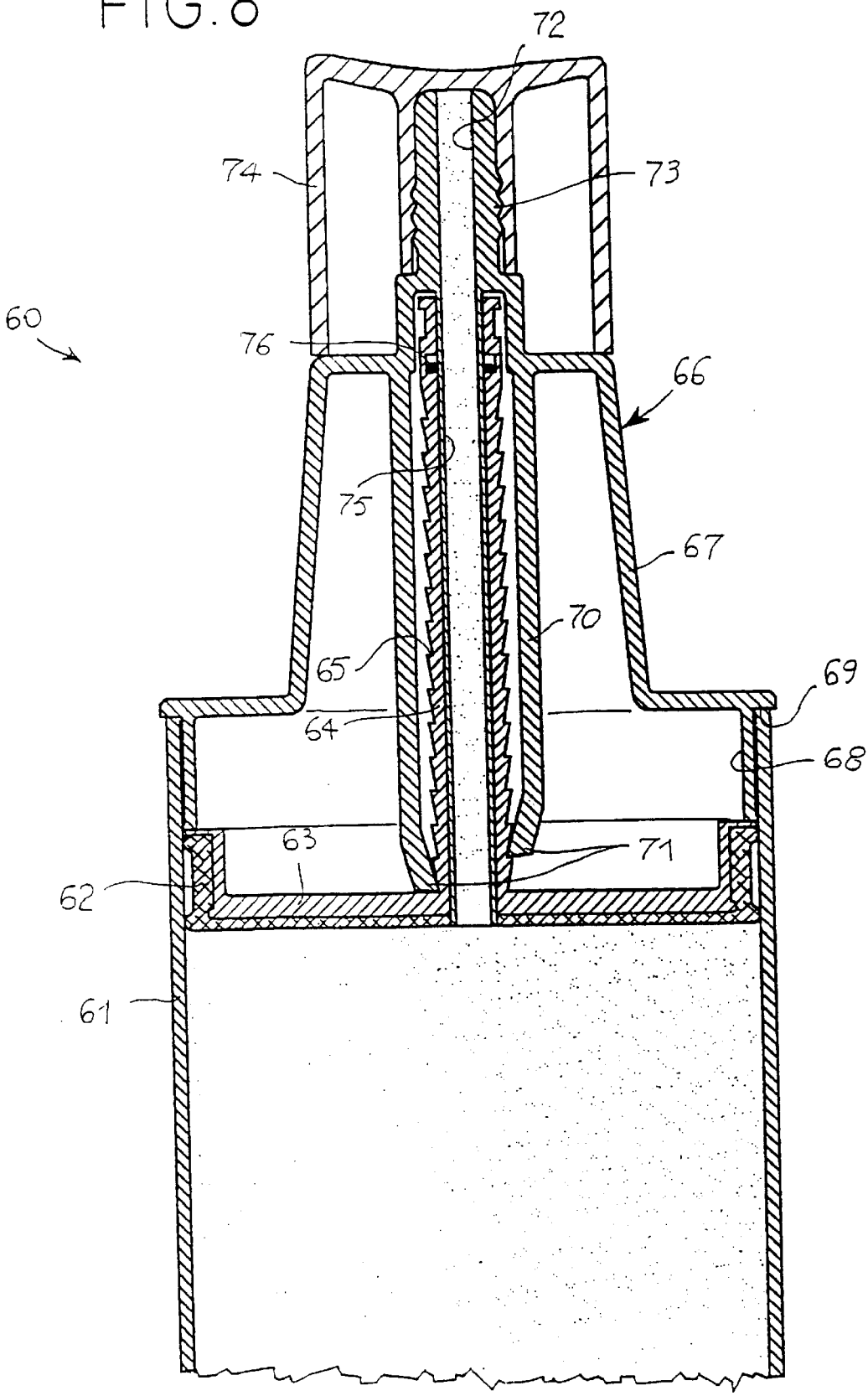
FIG. 8 is a section through a portion of the dispenser of FIG. 5, on an enlarged scale.

Another embodiment of a dispenser 60 shown in FIG. 5 and, in greater detail, in the enlarged view of FIG. 8, comprises a substantially cylindrical container 61 in which a piston disk 62, for example, but not exclusively, made of rubber or of an equivalent resilient material, is mounted for sliding in a leaktight manner; a thrust plate 63 bears on the piston disk and has a central tubular guide 64 which extends from a central region of the thrust plate 63. The outer surface of the tubular guide 64 has a set of teeth 65 with sloping surfaces, preferably in the form of a single tooth which extends around the outside of the tubular guide 64 in a helical configuration. An operating member 66 comprises an outer shell 67 with a mouth 68 having an annular abutment 69 for defining a travel limit against the upper edge of the cylindrical container 61. A tubular adjustment appendage 70 extends centrally inside the outer shell 67, surrounding the tubular guide 64 and having, at its end a thread or tooth 71 which engages in the sloping tooth 65. The tubular appendage 70 is extended above the shell 67 to form a dispensing nozzle 72 with an outer thread 73 onto which a cap 74 is screwed. The dispensing nozzle 72 is extended downwards inside and coaxially with the tubular appendage 70, by a dispensing duct 75 slidable axially in the tubular guide 64 in a leaktight manner by virtue of a seal 76, preferably an O-ring.

Figure 6:
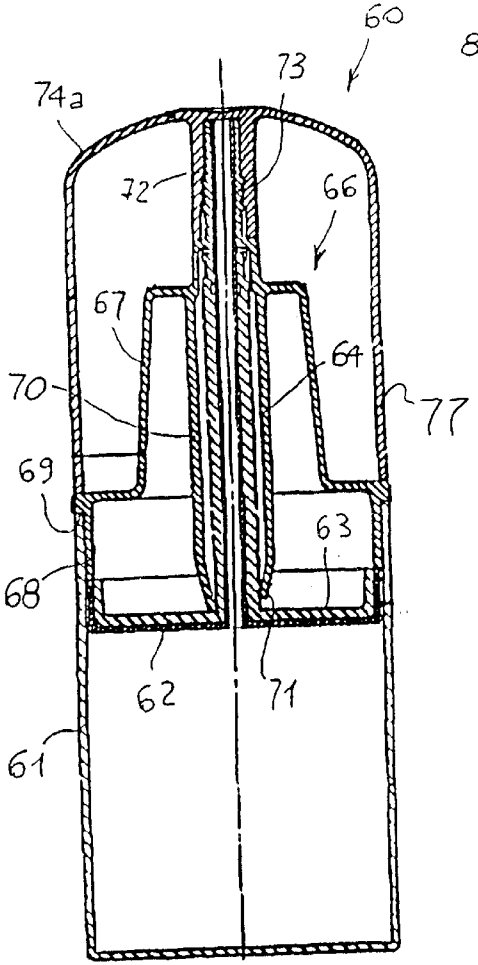
FIG. 6 shows a variant of the dispenser of FIG. 5 in longitudinal section.

FIG. 6 shows a variant of the dispenser 60 which differs basically in the different shape of the cap 74*a* which is domed and has an outer cylindrical skirt 77 having a diameter substantially equal to the diameter of the container 61.

The dispensers 60 shown in FIGS. 5, 6 and 8 can be operated, after the cap 74, 74*a* has been unscrewed, by first of all setting the quantity of product to be dispensed by rotating the operating member 66 in order to unscrew the tubular appendage 70 from the tubular guide 64 by a desired number of turns, by virtue of the movement of the tooth 71 on the helical tooth 65. During this operation, the shell 67 moves axially relative to the container 61, moving the annular abutment 69 away from the upper edge thereof. The metering operation just described may be assisted either by a graduated scale applied to the parts of the dispenser which are movable relative to one another, or by means of a sound signal, for example, produced by means of a flexible tongue which runs along a ramp-like track or the like during the rotation of the shell 67 and snaps loudly upon each rotation or partial rotation of the shell 67.

Upon completion of the rotation of the shell 67, the shell 67 and the base of the container 61 can be squeezed in order to slide them axially towards one another so that the end tooth 71 pushes the tubular guide and the thrust plate 63 and the piston disk 62 therewith, axially towards the base of the container 61. The consequent reduction in volume causes the product to be dispensed through the duct 75 and to emerge from the nozzle 72.

Figure 7:
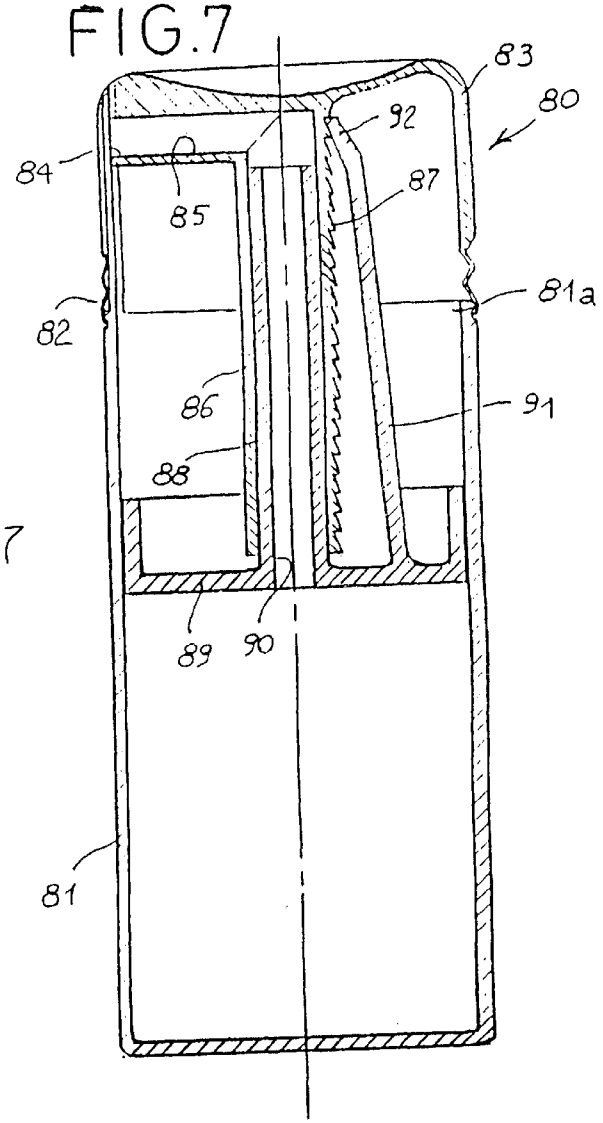
FIG. 7 shows, in longitudinal section, another dispenser which represents basically a variant of the dispenser of FIG. 2.

Another embodiment of the dispenser is shown in FIG. 7. This dispenser 80 comprises a substantially cylindrical container 81 on the upper edge 81*a* of which a bellows 82, extended at the top by a rigid cap structure 83, is engaged, fixed, or formed integrally. Inside the cap structure 83 there is a first dispensing duct 85 with an outlet nozzle 84, preferably at the side and possibly closed by a removable cap or plug. A tubular guide 86 extends in a central position inside the cap structure 83 and has an external set of teeth 87 with sloping surfaces. A rod 88 of a piston 89 slides inside the tubular guide 86, and a second dispensing duct 90 formed inside the piston 89 communicates with the interior of the container 81 at one end and opens into the first duct 85 at the other end. A flexible operating appendage 91 extends from the upper wall of the piston 89 outside the rod 88 and terminates in at least one tooth 92 which engages the set of teeth 87 formed on the tubular guide 86.

In the rest condition, the bellows 82 keeps the cap structure 83 raised from the container 81 and, in particular, from the rim 81*a* thereof. The exertion of a pressure on the cap structure 83 causes it to move towards the container 81, at the same time pushing the piston 89 downwards by means of the set of teeth 87 which interact with the appendage 92 fixed to the piston 89. The downward movement of the piston 89 forces the product contained in the container 81 to pass along the dispensing ducts 90 and 85 and to emerge from the nozzle 84. When the cap structure 82 is released, the bellows moves the cap structure away from the container 81. During this axial movement, the end tooth 92 can slide on the set of teeth 87 by virtue of the sloping shape thereof and by virtue of the flexibility of the appendage 91.

Figure 9:
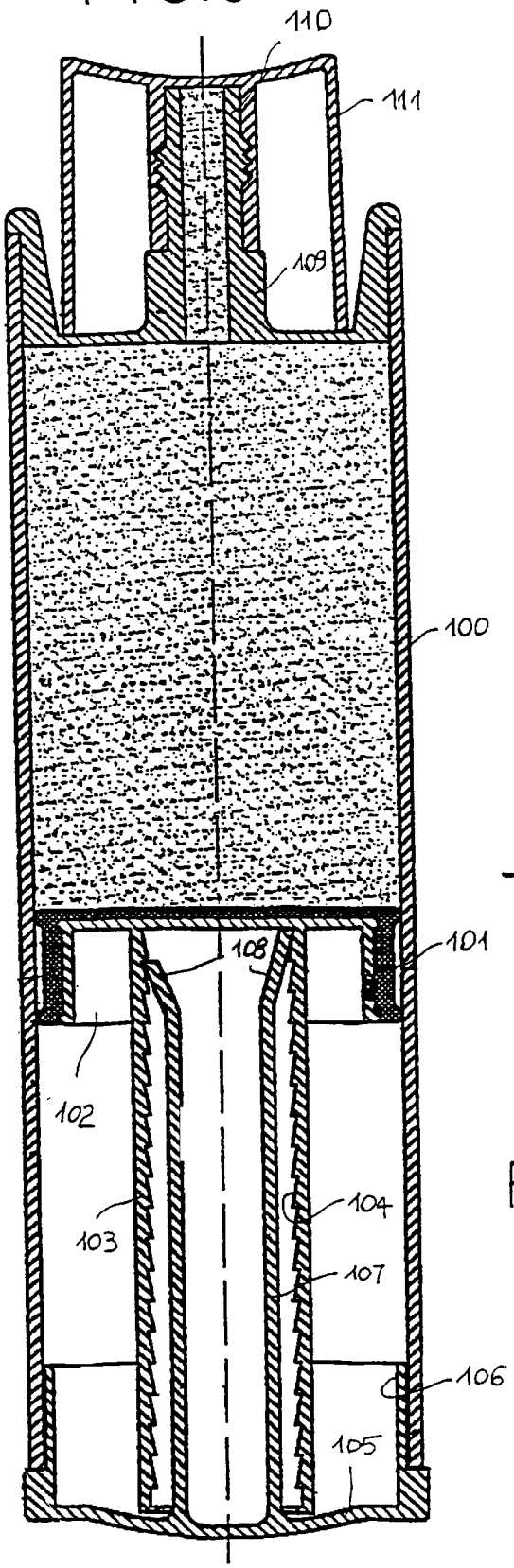
FIG. 9 shows a further embodiment of the present invention, in longitudinal section.

FIG. 9 shows a variant of the dispensers of FIGS. 5, 6 and 8, in which a cylindrical container 100 has a piston 101 on which a thrust plate 102 bears, a tubular duct 103 extending from the plate 102 in a central position, and having a tooth 104 having a sloping surface and extending in a helical configuration around the internal wall of the duct 103. A pressure member 105 comprises a tubular wall 106 which is housed movably at one end of the container 100, and from the centre of which a thrust tube 107 extends, the thrust tube having, at its end, a tooth 108 which engages the tooth 104. A plug 109 with a dispensing nozzle 110, onto which a cap 111 is screwed, is mounted on the other end of the container 100.

Figure 10:
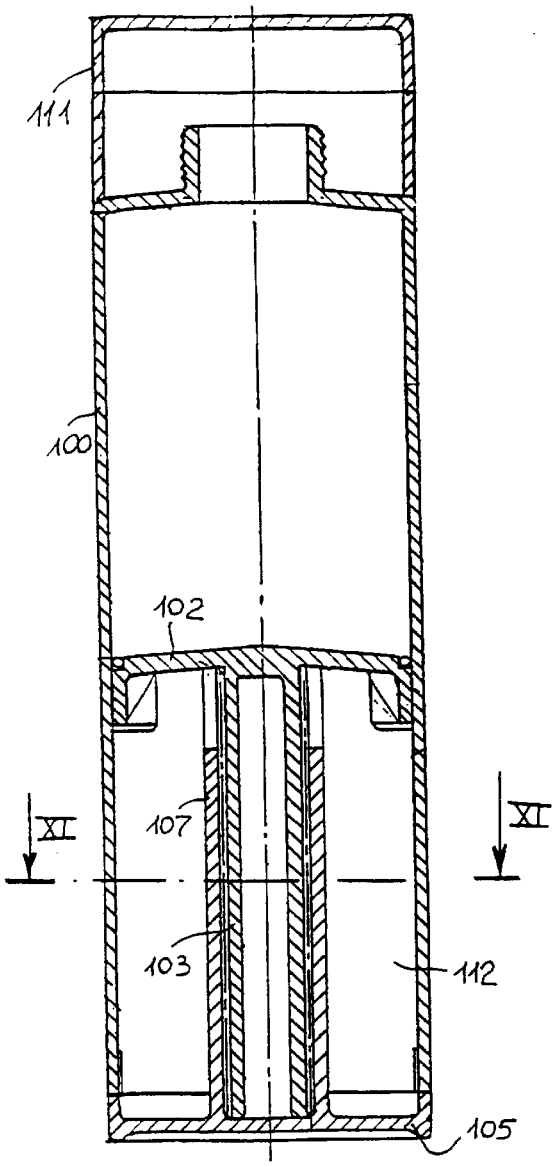
FIG. 10 shows a variant of the dispenser of FIG. 9, in longitudinal section.
Figure 11:
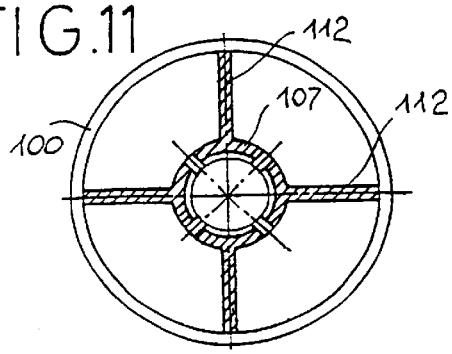
FIG. 11 is a transverse section taken on the line XI—XI of FIG. 10.

FIGS. 10 and 11 show a variant of the dispenser of FIG. 9 in which the tubular duct 103 fixed to the thrust plate 102 moves inside the thrust tube 107 which is split longitudinally and has fins 112 which, in the assembled configuration of the dispenser, interfere with the inside wall of the container 100 in order to keep the thrust tube 107 in contact with the tubular duct 103. It is thus possible to remove the unit constituted by the thrust plate 102 and the pressure member 105 from the container 100 in order to separate the pressure member quickly by opening the fins 112 out radially, so as to re-use the pressure member on other similar dispensers, discarding only the components which have come into contact with the product contained in the container 100.

The operation of the dispensers of FIGS. 9 and 10 is substantially similar to that described above with reference to FIGS. 5 and 6, with the sole difference that the product is dispensed in the same direction as the movement of the pressure member 105, through the dispensing nozzle 110 provided at the opposite end of the container 100. In this embodiment also, a graduated scale may be formed on the dispenser, enabling the quantity of product to be dispensed to be preset when the pressure member 105 is rotated before the actual dispensing operation. Moreover, as already described above, it is possible to provide a sound system, for example, by means of a flexible tongue, which provides an acoustic indication of the number of turns or partial turns through which the pressure member 105 is rotated prior to the dispensing of the product by sliding of the pressure member inside the container 100 until the pressure member abuts the edge of the container.

Although all of the embodiments described above relate to manually-operated dispensers, an expert in the art will have no difficulty in recognizing that an alternative, electric, air-operated or oil-operated drive system may be adopted by known means with the use of actuator circuits operated by such drive means.

Naturally, the principle of the invention remaining the same, the forms of embodiment and details of construction may be varied widely with respect to those described and illustrated purely by way of example, without thereby departing from the scope of the present invention.

What is claimed is:

1. A manual dispenser action comprising a reservoir body (11) communicating with a duct (15) opening outside the reservoir, a piston member (18) being mounted for sliding in a leaktight manner inside the reservoir body, actuator means adapted to make the piston member advance for a forward travel of predetermined maximum extent and to leave the piston member fixed at its position during return travel of the same actuator means to the starting position, said actuator means comprising an operative member rotatable about an axis parallel to the direction of advance of the piston member (18) and adapted to set the quantity of product to be dispensed by means of said rotation, wherein said duct (15) is formed inside a tubular body, is solidly fixed to said operative member and is fitted in a mouth (12) of the reservoir body (11), said duct opening outside a covering element (14) disposed adjacent said mouth (12) and wherein the operative member further comprises one or more flexible teeth (13) fixed to it and extending towards the reservoir body (11), which is provided with a stop member that co-operates with said flexible teeth (13) in order to define, together with the covering element (14), said forward travel of said piston member (18).

2. A manual dispenser with reciprocating action comprising a reservoir body (61, 100) communicating with a duct (75, 109) opening outside the reservoir, a piston member (62, 102) being mounted for sliding in a leaktight manner inside said reservoir body (61, 100), actuator means adapted to make said piston member (62, 102) advance for a forward travel of predetermined maximum extent and to leave said piston member fixed at its position during return travel of the same actuator means to the starting position, wherein said actuator means comprise an operative member (66, 105) rotatable about and axis parallel to the direction of advance of said piston member (62, 102), adapted to set the quantity of product to be dispensed by means of said rotation and provided with first engaging means (71, 108), wherein said actuator means further comprise a substantially tubular element (64, 103) fixed on said piston member (62, 102) provided with second engaging means (65, 104) on its surface, said first and second engaging means (65, 71, 104, 108) being in reciprocal functional engagement along an helical path in such manner that by rotating said operative member (66, 105) relatively to said substantially tubular element (64, 103), said operative member (66, 105) moves axially relatively to, and away from, said reservoir body (61, 100) during said return travel, thus defining said forward travel of the piston member (62, 102).

3. A manual dispenser according to claim 2, wherein said duct (75) is formed inside said tubular element (64).

4. A manual dispenser according to claim 2, said first engaging means (71, 108) are fixed to tubular element (70, 107) which is coaxially inserted into said first tubular element or coaxially surrounded by said first tubular element.

* * * * *